United States Patent [19]

Arnold, deceased et al.

[11] 4,117,490

[45] Sep. 26, 1978

[54] INCONSPICUOUS ANTENNA SYSTEM EMPLOYING THE AIRFRAME AS AN ANTENNA

[75] Inventors: James J. Arnold, deceased, late of Farmingdale, N.J., by Susan Arnold, executrix; Donn V. Campbell, Eatontown; Charles M. DeSantis, Neptune; Felix Schwering, Eatontown, all of N.J.

[73] Assignee: The United States of America as represented by the Secretary of the Army, Washington, D.C.

[21] Appl. No.: 824,364

[22] Filed: Aug. 15, 1977

[51] Int. Cl.[2] ..... H01Q 1/32

[52] U.S. Cl. ..... 343/708; 343/792

[58] Field of Search ..... 343/705, 708, 790, 791, 343/792, 853

[56] References Cited

U.S. PATENT DOCUMENTS 3,587,102 6/1971 Czerwinski ..... 343/708

FOREIGN PATENT DOCUMENTS 1,430,304 3/1976 United Kingdom ..... 343/708

*Primary Examiner*—Eli Lieberman

*Attorney, Agent, or Firm*—Nathan Edelberg; Sheldon Kanars; Bernard Franz

[57] ABSTRACT

A phase front homing system airborne antenna array which employs portions of the airframe as two antenna elements and wherein each antenna element includes a coaxial sleeve coupler.

12 Claims, 7 Drawing Figures

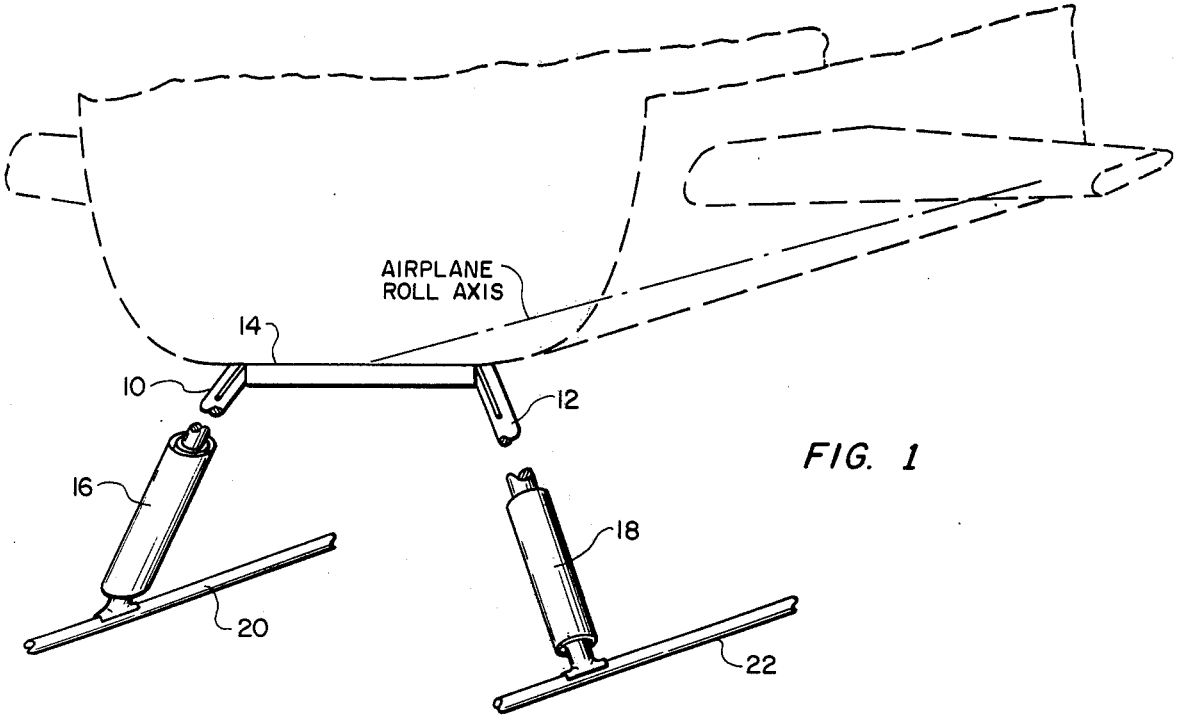
FIG. 1
FIG. 3
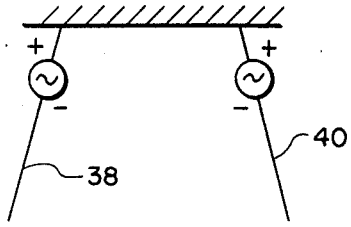
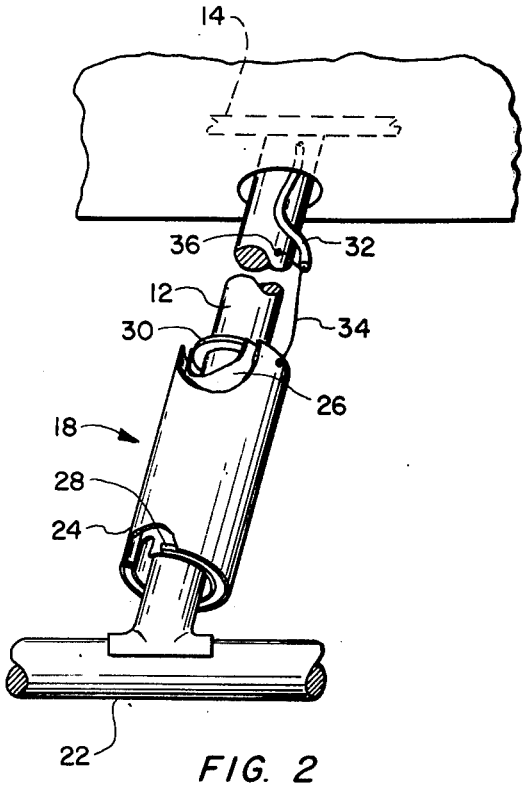
FIG. 2

INCONSPICUOUS ANTENNA SYSTEM EMPLOYING THE AIRFRAME AS AN ANTENNA

BACKGROUND OF THE INVENTION

This invention relates to radio direction finding systems adapted for homing operations and more particularly to a unique antenna array for use with phase front homing systems.

Radio direction finding systems enabling aviators to navigate aircraft towards distant beacon transmitters may operate by simply indicating only the sense of direction towards the beacon, i.e. right or left without any indication of the actual angle in degrees. Such simple systems are commonly called homing systems. The pilot observes an indicator on the homing apparatus, such as a needle, and maneuvers his aircraft so as to center the needle and thus "home" on the distant beacon transmitter. It is desirable that such homing systems should function accurately over wide frequency ranges. In the military VHF band, for example, it is desirable that the homing system extend over a relatively wide band extending from 30 to 76 MHz. Usually, however, most conventional homing systems will operate at a limited number of frequencies. Poor broadband performance of conventional homing systems is attributed to such factors as limited dynamic range and AGC characteristics of radios and, more significantly, the failure of the antenna system to provide symmetrical radiation patterns at all frequencies. To alleviate most of the problems of such conventional homing systems, so called phase front homing systems have been devised. Basically, the phase front homing system derives the desired sense of the direction to the beacon transmitter by utilizing directly the phase difference between the signals picked up by two antenna elements. In this sense, greater system accuracy is realized because the phase shift between antennas, ideally, is unaffected by amplitude variations. In contrast, the conventional homing system derives its information from both phase and amplitude characteristics of the antenna array and therefore it is more prone to inaccurate performance. Such phase front homing systems usually employ conventional separate, visible add-on antenna elements such as whips or dipoles. However, it is well known that the phase shift between such separate antenna elements of the homing antenna array is greatly affected by such factors as the type of aircraft and the location, orientation, and symmetry of the array.

BRIEF SUMMARY OF THE INVENTION

It is an object of the present invention to provide an improved phase homing system antenna wherein the antenna elements are concealed or greatly reduced in profile.

In accordance with the present invention, there is provided a phase front homing system airplane antenna comprising two substantially vertical sections of the airframe of the airplane. Included are discrete coaxial coupling sleeves, identical in structure, which encompass a portion of each of the vertical airframe sections such that the combination of each of the coupling means and its associated vertical section comprise one element of a pair of antennas of the system. Also included is a radio frequency feed line at each of the antenna elements which is connected between a respective coaxial sleeve and its associated vertical section. The phase front homing system derives the desired sense of direction to a prescribed beacon transmitter by utilizing directly the phase difference of the voltage at the two antenna elements.

BRIEF DESCRIPTION OF THE DRAWINGS

FIG. 1 is a plan view illustrating the present invention.

FIG. 2 illustrates the structure of one coaxial coupling sleeve and its associated vertical section.

FIG. 3 is a circuit representation of the present invention.

DESCRIPTION OF THE PREFERRED EMBODIMENT

Figure 4:
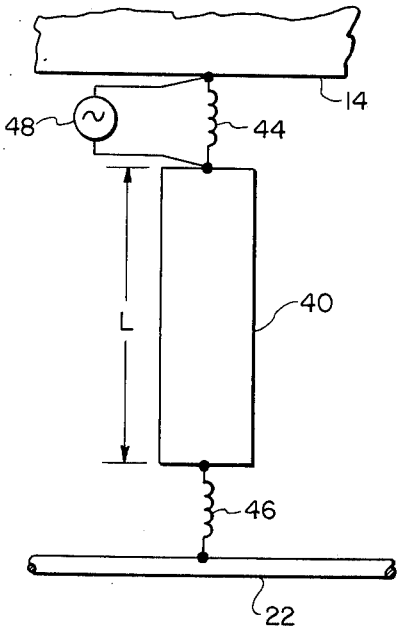
FIGS. 4–6 illustrate equivalent circuits for several embodiments of the present invention.

Although the present invention is described in connection with a fixed wing or rotary wing aircraft having substantially vertical landing gear struts, it is to be understood that the invention is not to be limited thereto.

Referring now to FIG. 1 of the drawing, 10 and 12 are the spaced metal struts of the landing gear of a conventional, relatively small, fixed wing or rotary wing aircraft. Struts 10 and 12 are connected to the airframe 14 and are assumed to be symmetrical with the center line or roll axis of the plane. As shown, the substantially vertical portions of struts 10 and 12 are girded or encompassed by respective metallic sleeve couplers 16 and 18, identical in structure, and which is shown in detail in FIG. 2. The struts 10 and 12 are terminated by respective landing gear skids 20 and 22.

Referring now to FIG. 2, the metal sleeve coupler 18 encompassing strut 12 intermediate airframe 14 and skid 22 includes two spaced concentric cylindrical metal sleeves, an outer sleeve 24 and an inner sleeve 26 of equal length. The inner sleeve 26 is radially spaced from strut 12 and the ends of cylindrical sleeves 24 and 26 proximal landing gear skid 22 are connected by a first annular metal ring 28. As shown, the annular ring 28 fills the space between outer sleeve 24 and inner sleeve 26 to provide a first electrical short as hereinafter explained. The end of inner cylindrical sleeve 26 proximal airframe 14 is connected to strut 12 by a second annular metal ring 30 to provide a second electrical short as hereinafter explained. An RF coaxial transmission line feed 32 is connected across the open end of outer sleeve 24 and strut 12 by having its inner conductor 34 connected to the open end of outer sleeve 24 and its outer conductor 36 connected to strut 12. With the arrangement hereabove described, the outer sleeve 24 and inner sleeve 26 comprise a first coaxial transmission line which is short circuited by annular ring 28. Similarly, the inner sleeve 26 and strut 12 comprise a second coaxial transmission line which is short circuited by annular ring 30. The combination of the first and second coaxial transmission lines together with strut 12 represents one element of a two element homing antenna. The second antenna element is identical and is associated with strut 10. Thus the encompassing respective couplers 16 and 18, together with the substantially vertical portions of respective struts 10 and 12, provide two homing antennas which are vertically polarized as is the incident electromagnetic wave of the homing beacon signal. A simplified circuit representation of the two element homing antenna is shown in FIG. 3. The antenna 38 on the left represents the antenna formed by strut 10 and coupling sleeve 16 while the antenna 40 on the right represents the antenna formed by strut 12 and coupling sleeve 18. The polarity shown is necessary to obtain the proper phase relationship of the two strut antennas 38 and 40 and must be observed when connecting the coupling sleeves 16 and 18 to their respective coaxial transmission line feeds.

In order to better understand the performance of the homing antenna shown in FIG. 3, it is first necessary to understand the equivalent circuit operation of the sleeve coupler 18. Referring now to the equivalent circuit shown in FIG. 4, the reactors 44 and 46 are shown connected in series with the strut antenna 40. The reactor 44 represents the reactance formed by the short circuited concentric sleeves 24 and 26 and the reactor 46 represents the reactance formed by the short circuited connection between strut 12 and inner sleeve 26. The coaxial feed transmission line 32 is represented by the voltage generator 48. The reactance provided by reactor 44 allows voltage generator 48 to excite the strut antenna 40 without being effectively short circuited. In effect, the coaxial arrangement of the sleeves 24 and 26 shown in FIG. 2 create artificial gaps in the strut 12 which can be used as terminals for excitation purposes. Although in FIG. 4 the strut antenna is shown as having the length L, it can be assumed that the antenna extends beyond L to the skid 22 which may act as the bottom load. With such an assumption, the whole landing gear structure may be regarded as a closed loop antenna which is energized against the airframe 14. In any event, it is clear that the sleeve coupler arrangement readily enables one to energize the antenna element 40. It is to be understood of course, that the antenna can be used for receiving as well as transmission. If desired, ferrous material such as powdered iron or ferrite may be used to fill the space between inner sleeve 26 and outer sleeve 24 and also the space between inner sleeve 26 and strut 12. If the spaces were completely filled with ferrous loading material, the characteristic impedance of each sleeve transmission line would then be increased by the factor $\sqrt{\mu_r/\epsilon_r}$ where the quantities $\mu_r$ and $\epsilon_r$ denote, respectively, the relative permeability and relative permitivity of the loading material. Similarly, the electrical length of each sleeve transmission line would increase by the factor $\sqrt{\mu_r \epsilon_r}$.

While it is recognized that the impedance of the antenna elements may vary in accordance with selected operating frequencies over a prescribed range, usually 30 to 75.95 MHz, suitable matching circuits well known in the art may be used to connect the coaxial feed transmission line 32 to respective sleeve antenna elements 38 and 40 in a conventional manner.

Figure 5:
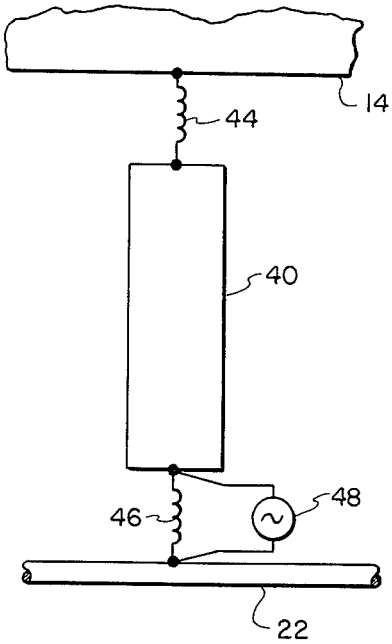

In the antenna hereinabove described, the feed transmission line 32 was connected to the upper end of the sleeve coupler 18 as shown in FIG. 2. However, the feed transmission line 32 may be connected to the lower or bottom end of sleeve coupler 18 so as to shift the antenna feed point without appreciably affecting the performance of the antenna. This is shown schematically in the equivalent circuit shown in FIG. 5 wherein like reference numerals refer to like elements. It is to be understood that by inverting the sleeve couplers of antenna element 40, the reactor 46 would then be located at the top and consequently top feed of the sleeve coupler could again be used to advantage.

Figure 6:
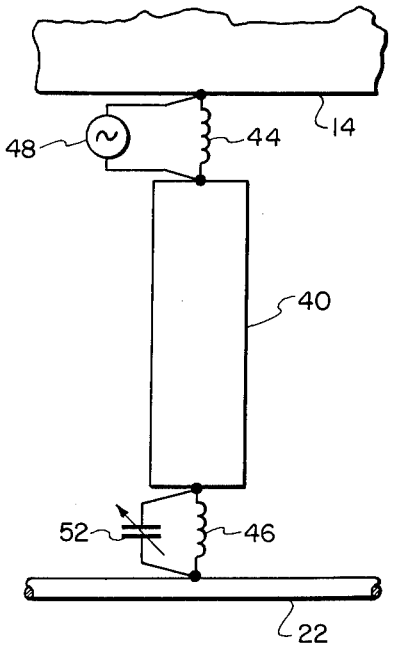

FIG. 6 is similar to FIG. 4 but differs only in that a variable capacitor 52 is shown connected across inner sleeve 26 so that electrically it is in parallel with reactor 46. When capacitor 52 is adjusted it causes the net reactance across inner sleeve 26 to vary. If tuned to resonate with reactor 46, for example, the vertical strut 12 would, in effect, be electrically disconnected from skid 22. Such an adjustable feature may provide some control over the current distribution of the strut antenna.

Figure 7:
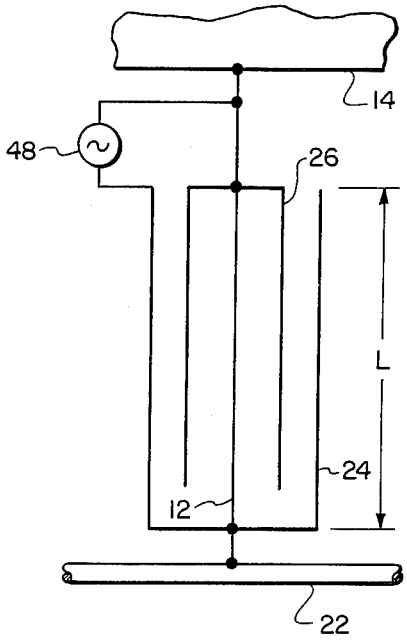
FIG. 7 is a schematic presentation of another embodiment of the invention.

FIG. 7 illustrates another embodiment of the invention. For simplicity, the cross-sections of the inner and outer sleeves 26 and 24, and the strut 12, are indicated by links which are referenced accordingly. The airframe 14 and skid 22 are also represented by line as shown and the RF feed connection 32 is represented by its equivalent generator 48. As shown, inner sleeve 26 is connected to strut 12 as indicated in FIG. 2. However, outer sleeve 24 is connected to strut 12 at its end proximal skid 22. By such an arrangement, the two sleeve transmission lines are, in effect, connected in series to provide a sleeve transmission line which is essentially doubled in length. This results in a substantial increase in the reactance of the sleeve transmission line and consequently, its shunting effect on generator 48 is greatly reduced. The reduced shunting effect is beneficial to the overall operation of the sleeve coupled antenna since it greatly simplifies the impedance matching problem.

In operation, it has been found that the phase shift characteristics of the strut antennas obtained in the frequency range of 30 to nearly 70 MHz are ideally suited to phase front homing. The phase nulls occur only at aircraft headings near 0° and near 180° within the 30–70 MHz frequency range. Also, it has been found that the radiation patterns of the strut antennas are nominally omnidirectional. It has alo been determined that the coupling to the struts increases the strength of the received signal by at least 14 db.

Although the antenna described hereinabove is directed to a homing type antenna, it is to be understood that the antenna is not limited to homing applications, but may also be used as a communication antenna. However, when used as a communication antenna, some type of impedance matching circuit will be required between the radio apparatus output and the antenna. Such matching circuits are well known and can readily be derived by persons well skilled in the art. It is also to be understood that any convenient metallic structural member of the aircraft can be put to use as an antenna or antenna array as hereinabove described. For example, the rear landing struts could also be excited by sleeve couplers to form a four element antenna array. Also the metal frame in the windshield could also be energized by the sleeve couplers. The sleeve coupling technique hereinabove described can also be used to excite structural members on buildings such as pipes, rain gutters, and leader pipes and conduits and thereby use them as antennas.

What is claimed is:

1. A phase front homing airplane antenna array comprising:

a pair of spaced substantially vertical sections of the metallic airframe of said airplane; and discrete coaxial coupling means comprising a pair of spaced concentric metallic cylindrical sleeves, identical in structure, encompassing a portion of said vertical sections, the combination of each of said coupling means and its associated vertical section comprising one of a pair of antennas of said array.

2. The antenna array in accordance with claim 1 wherein said sleeves are of equal length and wherein one pair of corresponding ends of said sleeves are interconnected by a first metallic ring.

3. The antenna array in accordance with claim 2 wherein the free end of the inner concentric sleeve is connected to said vertical section by a metallic ring.

4. The antenna array in accordance with claim 3 and further including a radio frequency feed line connected between the free end of the outer concentric sleeve and said vertical section.

5. The antenna array in accordance with claim 1 wherein said airplane includes symmetrically arranged landing gear struts and said struts comprise said vertical sections.

6. The antenna array in accordance with claim 5 wherein said coupling means comprises a pair of spaced concentric metallic cylindrical sleeves of equal length.

7. The antenna array in accordance with claim 6 wherein one pair of corresponding ends of said sleeves are interconnected by a first metallic ring and the free end of the inner sleeve is connected to said strut by a second metallic ring.

8. The antenna array in accordance with claim 7 and further including a radio frequency feed line connected between the free end of the outer concentric sleeve and said strut.

9. The antenna array in accordance with claim 3 and further including a radio frequency feed line connected between said interconnected corresponding sleeve ends and said vertical section.

10. The antenna array in accordance with claim 7 and further including a radio frequency feed line connected between said interconnected corresponding sleeve ends and said strut.

11. The antenna array in accordance with claim 1 wherein one end of the inner concentric sleeve is connected to said vertical section by a first metallic ring and the end of the outer concentric sleeve opposite said connected end is connected to said vertical section by a second metallic ring.

12. The antenna array in accordance with claim 11 and further including a radio frequency feed line connected between said vertical section and said second metallic ring.

* * * * *